US008704065B2

(12) United States Patent
Korfker

(10) Patent No.: US 8,704,065 B2
(45) Date of Patent: Apr. 22, 2014

(54) SHOULDER SUPPORT

(75) Inventor: Berent Korfker, Amsterdam (NL)

(73) Assignee: Gustav Pirazzi & Comp. KG (DE)

( * ) Notice: Subject to any disclaimer, the term of this patent is extended or adjusted under 35 U.S.C. 154(b) by 0 days.

(21) Appl. No.: 13/578,190

(22) PCT Filed: Feb. 8, 2011

(86) PCT No.: PCT/EP2011/000573

§ 371 (c)(1),
(2), (4) Date: Oct. 18, 2012

(87) PCT Pub. No.: WO2011/098248

PCT Pub. Date: Aug. 18, 2011

(65) Prior Publication Data

US 2013/0125728 A1 May 23, 2013

(30) Foreign Application Priority Data

Feb. 12, 2010 (DE) ..... 10 2010 007 935

(51) Int. Cl.
*G10D 1/02* (2006.01)

(52) U.S. Cl.
USPC ..... 84/280

(58) Field of Classification Search
USPC ..... 84/280; D17/20
See application file for complete search history.

(56) References Cited

U.S. PATENT DOCUMENTS

| | | | | |
|---|---|---|---|---|
| 3,298,269 | A | 1/1967 | Walker | |
| 3,407,695 | A * | 10/1968 | Perlman | 84/280 |
| 3,631,754 | A * | 1/1972 | Kun | 84/280 |
| 4,062,695 | A | 12/1977 | Pieck | |
| 4,185,534 | A | 1/1980 | Cove | |
| 4,719,835 | A | 1/1988 | Biasini et al. | |
| 6,670,533 | B1 * | 12/2003 | Yeh | 84/278 |
| 7,262,352 | B1 | 8/2007 | Lavorata | |
| 7,265,284 | B2 | 9/2007 | Muir et al. | |
| 7,476,789 | B1 | 1/2009 | Federici | |
| 7,488,877 | B2 | 2/2009 | Cheng et al. | |
| 2010/0242703 | A1 * | 9/2010 | Ruan | 84/280 |

FOREIGN PATENT DOCUMENTS

| | | | |
|---|---|---|---|
| DE | 2009097 | A1 | 9/1970 |
| DE | 3643225 | | 7/1987 |
| DE | 3707656 | C1 | 6/1988 |
| DE | 10007834 | | 8/2000 |
| DE | 102007038004 | | 2/2009 |
| EP | 353824 | | 2/1990 |
| EP | 507994 | | 10/1992 |
| EP | 540978 | | 5/1993 |
| GB | 2444972 | A | 6/2008 |
| JP | 10214081 | A | 8/1998 |

OTHER PUBLICATIONS

English Translation of International Preliminary Report on Patentability for International (PCT) Patent Application No. PCT/EP2011/000573, mailed Aug. 23, 2012, 7 pages.
International Search Report prepared by the European Patent Office on Mar. 2, 2012, for International Application No. PCT/EP2011/000573.

* cited by examiner

*Primary Examiner* — Jianchun Qin
(74) *Attorney, Agent, or Firm* — Sheridan Ross P.C.

(57) ABSTRACT

The invention relates to a shoulder support (30) for a bowed instrument having a support element (32) for placing on the shoulder and/or chest of the player. To that end, there is provision according to the invention for the support element (32) of the shoulder support (30) to be produced from a thermoplastic material.

12 Claims, 4 Drawing Sheets

SHOULDER SUPPORT

CROSS REFERENCE TO RELATED APPLICATIONS

This application is a national stage application under 35 U.S.C. 371 of PCT Application No. PCT/EP2011/000573 having an international filing date of 8 Feb. 2011, which designated the United States, which PCT application claimed the benefit of German Application No. 10 2010 007 935.9 filed 12 Feb. 2010, the entire disclosure of each of which is incorporated herein by reference.

The invention relates to a shoulder support for a bowed instrument, in particular for a violin or viola, having a support element for placing on the shoulder and/or chest of the player.

Bowed instruments, in particular violins and violas, are held during playing at their body end between the chin and shoulder of the musician. However, since the spacing between the head of the player and the shoulder region is generally greater than the thickness of the instrument, it is only possible for the musician to securely hold or clamp the instrument in a very uncomfortable stance such that—if it is possible to play the instrument at all—impairments of the playing quality cannot be avoided. In order to counteract this, so-called chin supports, also known as chin rests, and shoulder supports for violins and violas have been developed.

These shoulder supports are removably fitted to the body of the instrument using a retention device and consequently serve to make holding the instrument more comfortable for the musician. In principle, a shoulder support is fixed to a violin or the like and forms a support face which rests on the shoulder of the musician, the instrument itself being supported at a selected level. This is in particular dependent on the physique, in particular the neck length, the shoulder shape and the fiddling position, of the musician. Such shoulder supports are known, for example, from EP 507 994 B1, U.S. Pat. No. 4,062,695, DE 10007834 A1, U.S. Pat. No. 7,265,284 or U.S. Pat. No. 7,488,877 B2.

The shoulder supports may be constructed with a fixed base. However, this is generally shaped only inadequately with respect to the shoulder of the musician and consequently adapted in an individual manner such that generally some losses with respect to playing comfort and convenience must be accepted. However, for reasons of comfort, the bottom of the fixed base may also be provided with a cushion which rests on the shoulder of the musician when the instrument is played. At both ends of the base, upwardly protruding retention elements or carrying elements are secured, which carry pivotable, fork-like end pieces. These may be fitted to the lateral walls of the instrument body close to the body base. In order to be able to secure this type of shoulder support to the instrument in a secure manner, the base of the shoulder support has a degree of inherent resilience and this serves to produce a degree of clamping force with which the fork-like end pieces grip the instrument. End pieces are also known in other configurations in combination with the carrier elements but for the most part all grip the instrument with a given clamping effect.

For a high grade of sound quality and harmony with the instrument, such shoulder supports are generally produced from plastics or synthetic material, but more recently also from wood or wood-based materials and are adapted in terms of their contour in an at least approximately individual manner to the body shape of the player. Consequently, the player is intended inter alia to be able to play the instrument in a particularly comfortable and harmonious manner without impairment of his concentration or his attention.

However, a particularly individualised shaping and contouring of the shoulder support adapted to the personal requirements and preferences of a player is generally not possible at all or only with considerable complexity and with the use of special resources, for example machines or the like.

The object of the invention is therefore to specify a shoulder support of the above-mentioned type, for which, in a particularly simple manner, and in particular also in a manner which the user can carry out himself, a shape which is particularly substantially adapted to the user and consequently a particularly high level of playing quality overall can be achieved.

This object is achieved according to the invention by the support element of the shoulder support being produced from a thermoplastic material. Alternatively, the support element may also be produced from a material which softens under the effect of light of a predetermined wavelength and/or which softens under the influence of a magnetic field.

The invention is based on the consideration that, particularly in the case of high demands and expectations of the sound quality and the playing behaviour of the assembly comprising the instrument on the one hand and shoulder support on the other hand, a contour adaptation of the support element of the shoulder support to the shoulder or the chest of the player should be carried out. Furthermore, however, in order also to allow a subsequent improvement of the shape of the shoulder support in the manner of a gradual adaptation to the body shape of the user for any potentially necessary improvement or optimisation of the contouring with negligible complexity, a modification of the shaping should in principle be possible by the user himself, in particular therefore without using specialist operators or corresponding tools or infrastructure. To this end, the support element of the shoulder piece should be produced from a suitably selected, subsequently deformable material.

To this end, a material which softens under the effect of light of a predetermined wavelength and/or which softens under the influence of a magnetic field may be provided, such that, with the ambient conditions being specified (irradiation with the provided light; activation of the magnetic field), the deformability can be selectively activated. After the desired shape adaptation has been carried out, the ambient conditions can then be adjusted again (end or change of the irradiation; deactivation of the magnetic field) such that the material is hardened again and retains the imparted desired shape.

In particular, however, there is provision for the use of thermoplastic material for forming the support element. A thermoplastic material, or a so-called thermoplast, also referred to as a plastomer, is intended to be understood to be a plastics material which can be readily (thermoplastically) deformed in a specific temperature range, that is to say, above the so-called transition temperature $T_g$. This operation is reversible, that is to say, it can be repeated as often as desired by means of cooling and reheating, as long as the so-called thermal decomposition of the material is not initiated by overheating. The deformation of the material and consequently the contour adaptation of the support element of the shoulder support can be carried out by means of heating to a temperature above the mentioned transition temperature $T_g$, subsequent contour shaping and subsequent cooling to a temperature below the transition temperature with the predetermined shape being maintained. A subsequent change of the contour, for example in order to improve the contour adaptation to the previous player, can be carried out by means of reheating to a temperature above the transition temperature, further deformation and subsequent cooling again. In particular, the user himself can gradually improve and update the contour adaptation in a simple and direct manner.

In a particularly preferred manner, a so-called "shape memory polymer" is provided as a thermoplastic material. With such materials, initial shaping is carried out, from which deviations can later be carried out by means of subsequent further processing and further contouring by means of corresponding thermal processing. However, should reheating to a temperature above the transition temperature take place without external shaping influences, such a material assumes its originally predetermined shape again (so-called "shape memory"). Owing to the use of such a material, there can consequently be predetermined for the shoulder support and the support element thereof a basic shape which can subsequently be modified as often as desired and can be adapted to individual concerns of the respective player. If, after repeated shape modification, an undesirably complex overall contour or the like should be produced, owing to the shape memory effect the original shape can also be initially reproduced if necessary, from which the currently desired shape can potentially be adjusted in a particularly simple manner. A material which is considered to be particularly suitable for use in such a context is, for example, the "shape memory" material which can be obtained under the trade name "Veriflex".

Especially for use in the support element of a shoulder support, a particularly suitable thermoplastic material is one that can be influenced selectively in a shaping manner within specific limits under substantially conventional ambient conditions and by means of only a small application of heat. To this end, in an advantageous embodiment, the thermoplastic material which forms the support element is selected in such a manner that it has a transition temperature in the thermoplastic range $T_g$ of between approximately 43° C. and approximately 60° C., preferably of approximately 50° C. It is therefore ensured that with comparatively little heating, for example using a hairdryer or the like, the shaping is enabled, whereas under conventional ambient conditions no further deformation of the support element occurs. As has further surprisingly been found with the use of the material "Veriflex", which is considered to be particularly suitable, the sound behaviour of a shoulder support constructed in this manner is also particularly advantageous for a transition temperature $T_g$ of approximately 50° C. It has been found that a higher transition temperature leads to rather brittle sound behaviour, whereas a lower transition temperature results in increased absorption of resonances. With respect to the sound properties the specification of a transition temperature of from 45° C. to 55° C., in particular of approximately 50° C., is consequently particularly advantageous for the material selection for the support element of the shoulder support. This selection of the transition temperature further also allows the user to apply the required heat in a particularly simple manner, for example by using a conventional hairdryer.

In order to further ensure particularly high levels of quality of the support element in terms of sound and consequently ensure particularly high-grade properties for the assembly comprising the instrument and shoulder support, the thermoplastic material which forms the support element is advantageously selected with a density of between 0.8 and 1.5 g/cm$^3$, preferably of approximately 1.1 g/cm$^3$. Owing to the specification of a material having a density in this range, the vibration behaviour of the material and consequently of the support element is substantially comparable to that of hard or hardened wood, and therefore particularly advantageous sound conducting properties and sound properties can be achieved.

As has further surprisingly been found, for a particularly advantageous combination of sound properties on the one hand and comfort and user-friendly (contour) properties on the other hand, the selection of suitable geometric parameters for the support element of the shoulder support is significant. In a particularly advantageous embodiment, the cross-sectional area of the support element, with respect to the longitudinal direction thereof, should be at least 100 mm$^2$ and at most 250 mm$^2$. In particular, the cross-sectional area should be substantially uniform in shape and where possible change only slightly over the longitudinal direction of the shoulder support, since modifications of the cross-sectional area appear to cause disturbances in the sound behaviour. Furthermore, it has surprisingly been found with regard to the sound properties that with high material thickness (correspondingly large cross-sectional area), the sound behaviour is rather saturated but also less open and coarse in terms of tone.

If, on the other hand, less material is provided (correspondingly lower cross-sectional area), more open sound behaviour can be achieved which, however, appears to become too hard when the material thickness is too low. In an advantageous embodiment, the support element therefore has a thickness of at least 2 mm and at most 7 mm, preferably at least 3 mm and at most 6 mm, particularly preferably at least 3.4 mm and at most 5.5 mm.

In order to ensure a particularly high level of carrying comfort under these constraints and consequently particularly favourable playability, the width of the support element is in addition advantageously also selected in an appropriate manner. Advantageously, there is provision for a width of the support element of at least 20 mm and at most 45 mm, particularly preferably at least 25 mm and at most 40 mm, preferably of at least 30 mm and at most 35 mm.

As another particularly preferred dimension specification, it has been found that, with regard to sufficient stability and structural integrity, the material should be at least 3 mm thick at a width of 35 mm, whereas with a width of 33 mm, a thickness of between 3.4 mm and 5.5 mm should be selected. In contrast, for a width of 25 mm, an ideal thickness of from 4 mm to 6 mm is advantageous. The above values are particularly favourable dimension specifications for a shoulder support which is constructed independently.

Instead, the use of a shoulder support in combination with an adapter piece, which is intended to allow coupling of the shoulder support to the instrument whilst minimising the impairment of sound qualities, is also considered. When such an adapter piece is used, as known, for example, from DE 10 2007 038 004 A1, the support element advantageously has a minimum cross-section of 60 mm$^2$, preferably a cross-section of at least 75 mm$^2$. In particular, the support element may advantageously have a thickness of 3 mm and a width of 25 mm.

A considerable improvement of the sound properties of the assembly comprising the instrument and shoulder support can be achieved by the support element of the shoulder support being provided with a plurality of holes in a particularly advantageous configuration. Owing to such a configuration of the support element, which has independent inventive significance, and which also provides, regardless of the material selection, a considerable improvement of the sound qualities when the shoulder support is used, but which is also advantageous in combination with the specified material selection for the support element, the vibration behaviour of the shoulder support and the acoustic coupling to the vibration behaviour of the instrument per se is particularly favourable and free from interference, such that overall a particularly high level of sound quality can be achieved when the instrument is played.

Advantageously, at least some of the holes are arranged centrally in the support element, with respect to the width thereof. Furthermore, for particularly harmonious vibration behaviour, all or at least some of the holes should advantageously be selected to be of the same size in terms of their diameter. As has further surprisingly been found, particularly favourable vibration behaviour can be achieved by the sum of the diameters of the holes advantageously being only at most slightly smaller (up to −20%) or particularly preferably greater than the maximum width of the support element.

As has further been surprisingly found, a particularly high level of tonal quality of the assembly comprising the instrument and shoulder support can be achieved by the sum of the areas of the holes advantageously taking up approximately from 1% to 10%, preferably from 2 to 5%, of the total surface of the support element. In an alternative or additional advantageous development, the holes are constructed with sharp edges. In comparison with holes with rounded edges, a particularly pleasant tone can thereby be achieved.

It is also surprisingly favourable for the tone if an uneven total number of holes is advantageously provided.

The advantages achieved with the invention are in particular that, owing to the production of the support element of the shoulder support from thermoplastic material, particularly extensive individualised contouring which is adapted to the respective user is made possible, which can be subsequently modified again and consequently improved or also adapted to other users. This adaptation can be carried out in a particularly simple manner by the user himself, without use of specialised operators or corresponding machines being necessary. By appropriate specification of the material parameters, for example transition temperature and/or density and the geometric parameters, for example thickness and width, it is additionally possible to achieve particularly favourable acoustic behaviour of the shoulder support, which makes it particularly suitable with respect to use with a violin.

An embodiment of the invention is explained in greater detail with reference to the drawings, in which.

Components which are identical have been given the same reference numerals in all the figures.

Figure 1:
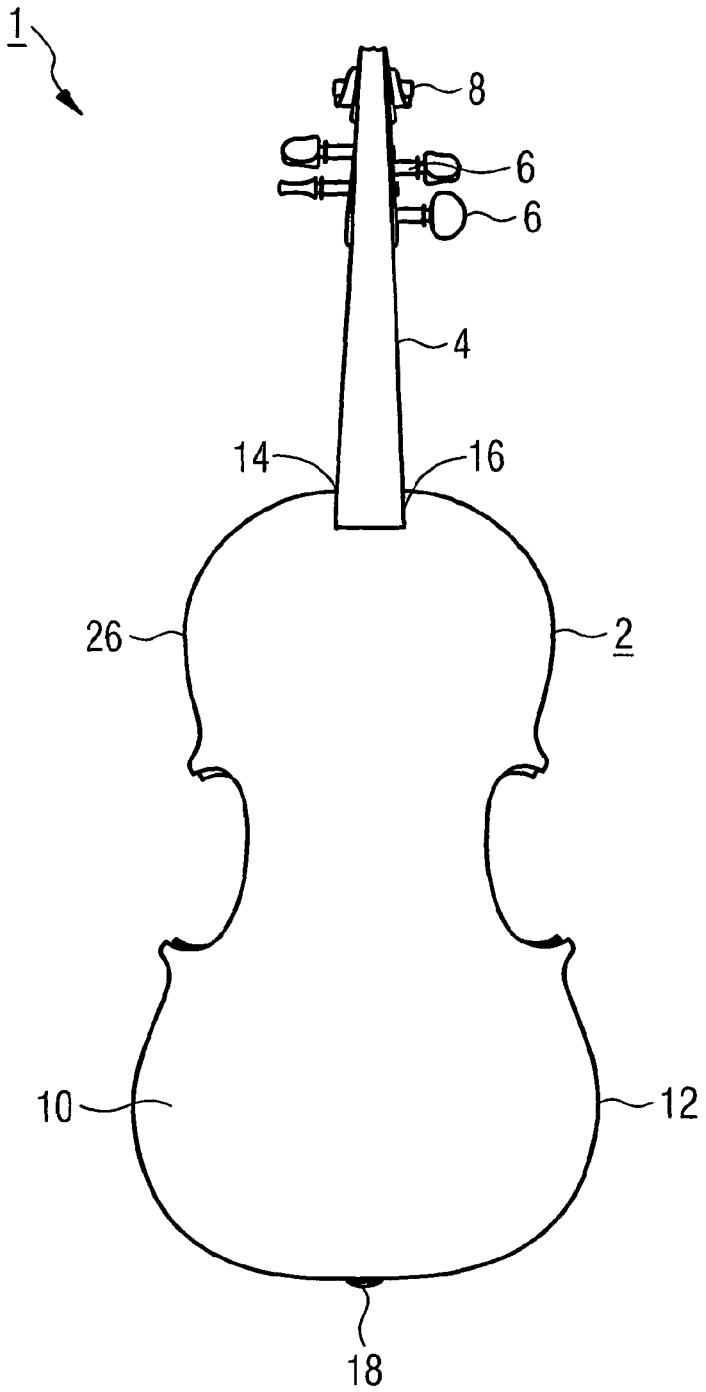
FIG. 1 is a view of the underside of a classical violin.

A classical violin 1 according to FIG. 1 comprises a body 2, which forms the sound box, a neck 4, to which a fingerboard is fitted, and a pegbox with pegs 6, the end of which pegbox forms a scroll 8. The body 2 has a body base 10 and a peripheral base edge 12. At the neck end 14 of the body 2, the neck 4 of the violin 1 is connected to the body 2 by means of the upper end block 16. Other blocks which serve to stabilise the violin 1 are incorporated in the body 2.

At the lower end block 18, the strings of the violin 1 are tensioned by means of a tailpiece end on the upper side of the violin 1. Therefore, the lower end block 18 is very stably and securely incorporated to the body 2. The upper end block 16, which carries the neck 4 and the fingerboard, is also incorporated in the body 2 in a stable and fixed manner. The upper end block 16 and the neck 4 are usually produced separately nowadays and adhesively bonded to each other in order to provide the necessary carrying properties and also sound and vibration properties.

Lateral walls, so-called ribs 26, are positioned laterally on the body base 10 in the region of the peripheral bottom edge 12 and then a body cover is fitted on these ribs 26 opposite the body base. These components substantially form the body 2 which forms the sound box of the violin 1 and are stabilised by means of the so-called outer blocks and the upper and lower end block 16, 18.

Figure 2:
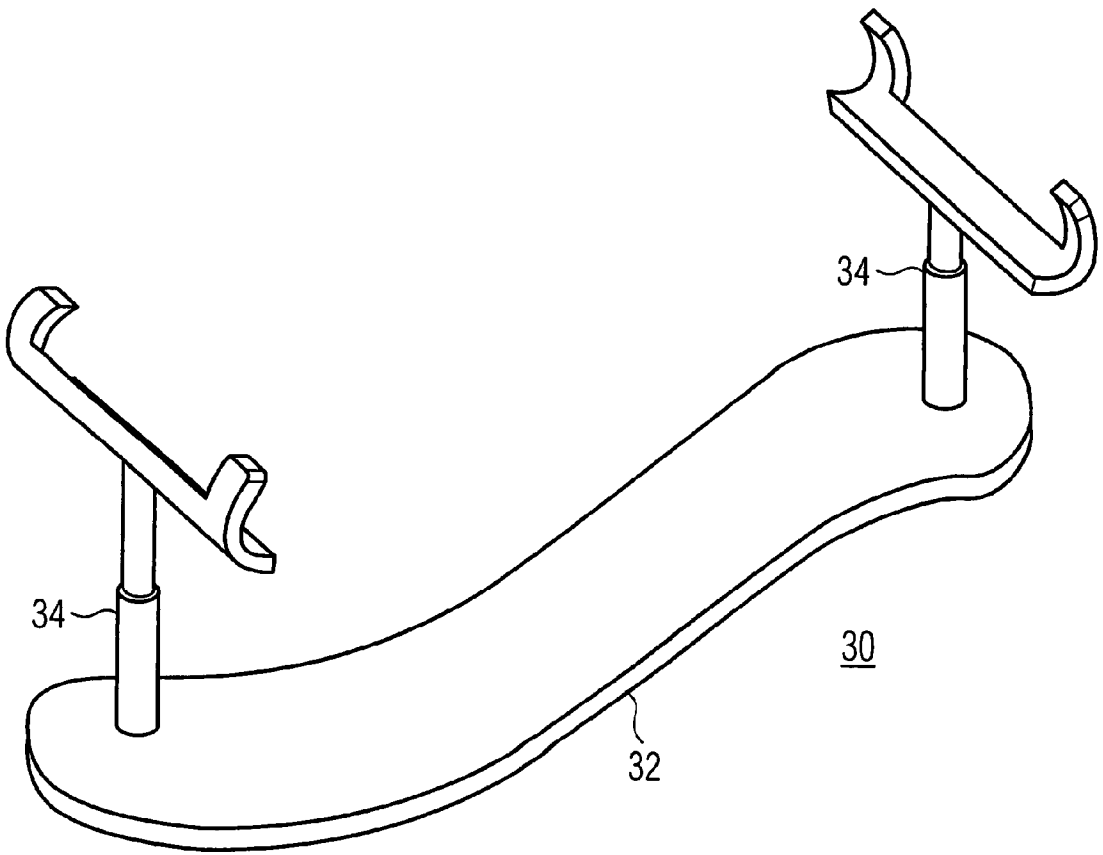
FIG. 2 shows a shoulder support for the violin according to FIG. 1.
Figure 3:
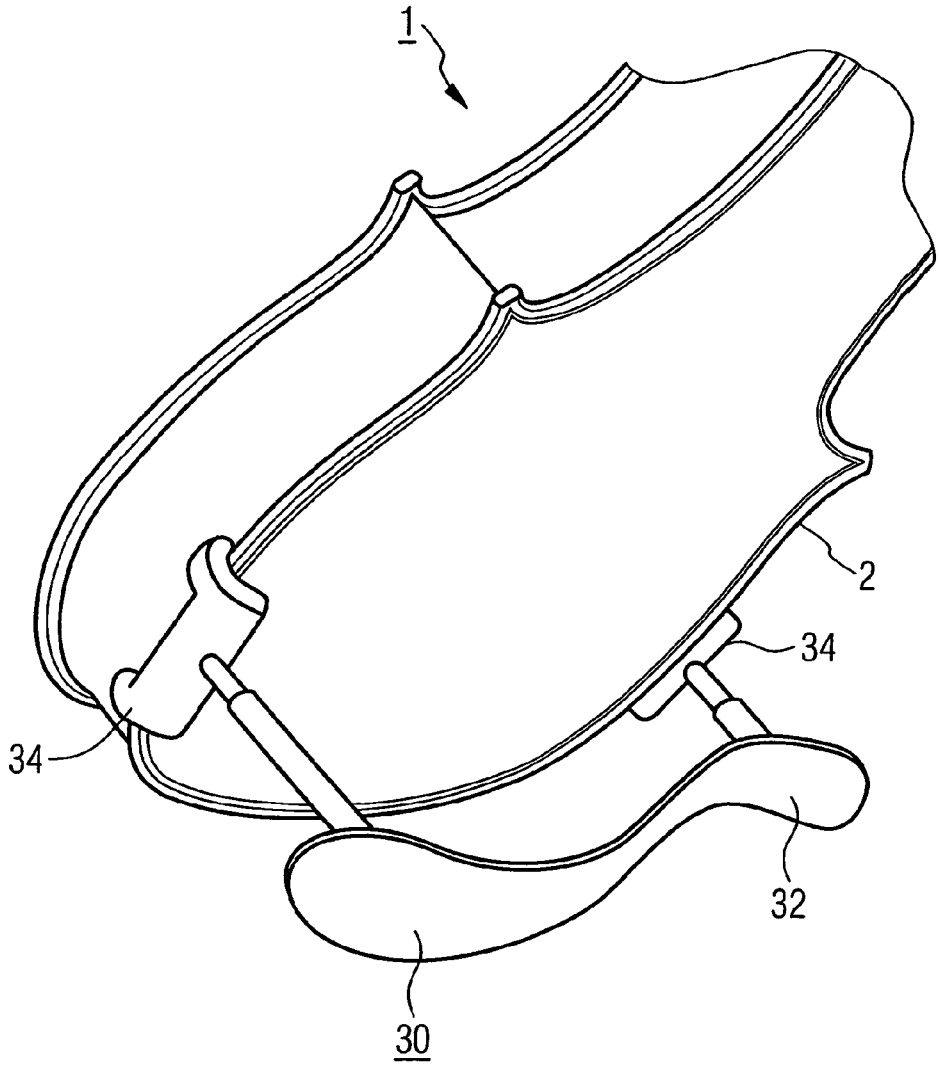
FIG. 3 is a partial perspective view of the violin with the shoulder piece fitted.

In order to allow the musician to have a comfortable stance when playing the violin 1, with better sound quality of the violin 1, a shoulder support 30 is provided, as illustrated in FIG. 2 as a separate component and in FIG. 3 in the mounted state fitted to the body 2 of the violin 1. The shoulder support 30 per se comprises a support element 32 which is provided for placing on the shoulder and/or chest of the player and which can be fitted to the body 2 of the violin 1 and in particular to the peripheral bottom edge 12 via clamping units 34 arranged at the ends. In the embodiment, the shoulder support 30 can consequently be fitted directly to the body 2 of the violin 1 via the clamping units 34; alternatively, however, the additional use of an adapter piece could also be provided for between the shoulder support 30 and the body 2.

For particularly good playability with a high level of carrying comfort, the support element 32 of the shoulder support 30 is constructed in a contoured manner, individualised adaptation to the player being provided by the shaping or contouring of the support element 32. In order to allow particularly individualised shaping and adaptation which can also be carried out by the user himself, the support element 32 of the shoulder support 30 is produced from thermoplastic material.

In order to contour or individually adapt the shape of the support element 32 to the user, there is provision for the support element 32 to be heated to a temperature above the thermoplastic transition temperature of the thermoplastic material forming the support element 32. In this heated state, the shaping may be carried out, with the material subsequently cooling so as to retain the predetermined shape. If, for example for subsequent improvement of the shaping of the shoulder support in the manner of a gradual adaptation to the physique of the user for potentially necessary improvement or optimisation of the contouring or the like, adaptation of the contouring is intended to be carried out, only reheating of the support element 32 to a correspondingly high temperature, a change in the shaping and subsequent re-cooling are necessary.

In order, on the one hand, to allow such contouring of the support element 32 in a particularly simple manner but without, on the other hand, independent deformations occurring under common ambient conditions, a material having a thermoplastic transition temperature of approximately 50° C. is selected in the embodiment in order to form the support element 32. In the embodiment, a material having a density of approximately 1.13 g/cm$^3$ is further selected such that, owing to sound conduction properties which are comparable with wood, a particularly high level of sound quality of the assembly comprising the violin 1 and shoulder support 30 is ensured. With regard to the dimensions of the shoulder support 30, it is further taken into consideration that the cross-sectional area of the support element 32, viewed in a longitudinal direction, should remain as constant as possible and should have a value of at least 100 mm$^2$ and at most 250 mm$^2$. In the embodiment, the support element 32 further has a width of 35 mm and a thickness of 4.5 mm.

Figure 4:
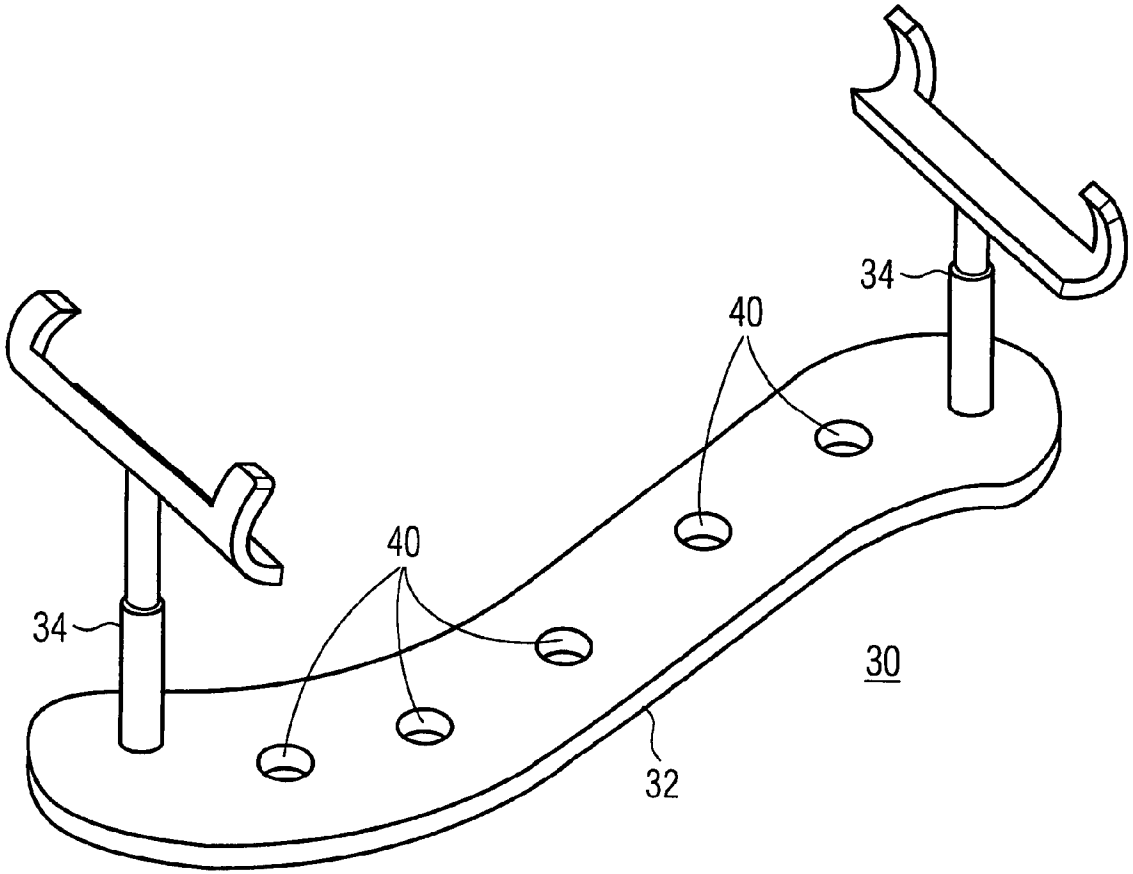
FIG. 4 shows an alternative configuration of a shoulder support.

An alternative embodiment of a shoulder support 30 is shown in FIG. 4. Similarly to the shoulder support 30 according to FIG. 2, the support element 32 is produced from a thermoplastic material in this instance. In the embodiment according to FIG. 4, however, the support element 32 also has a plurality of holes 40 which are arranged centrally in relation to the width of the support element 32. The holes 40, which substantially improve the vibration behaviour and therefore the sound behaviour of the shoulder piece 30, are selected so as to be of the same size with regard to the diameter thereof, the sum of the diameters of the holes being greater than the maximum width of the support element. In the embodiment, the holes 40 are dimensioned in such a manner that they take up in total a surface-area of 4% of the surface of the support element.

LIST OF REFERENCE NUMERALS

1 Violin
2 Body
4 Neck
6 Peg
8 Scroll
10 Body base
12 Base edge
14 Neck-side ends
16, 18 End block
20, 22 Outer block
24 Curvature
26 Rib
30 Shoulder support
32 Support element
34 Clamping unit
40 Holes

The invention claimed is:

1. A shoulder support for a bowed instrument having a support element for placing on the shoulder and/or chest of the player, wherein the support element is provided with a plurality of open holes, wherein a side of the holes is configured to contact the player and the depth of the holes extends through the entire thickness of the support element, wherein at least some of the holes are selected to be of substantially the same size in terms of their diameter, and wherein the sum of the diameters of the holes is as large as at least 80% of the maximum width of the support element.

2. The shoulder support according to claim 1, wherein at least some of the holes are arranged centrally in the support element with respect to the width thereof.

3. The shoulder support according to claim 1, wherein the holes take up a total surface-area of between 1 and 10%, preferably between 2 and 5%, of the surface of the support element.

4. The shoulder support according to claim 1, the holes of which are constructed with sharp edges.

5. The shoulder support according to claim 1, wherein the total number of holes (40) is uneven.

6. The shoulder support according to claim 1, wherein the support element is produced from a material which is thermoplastic and/or which softens under the effect of light of a predetermined wavelength and/or which softens under the influence of a magnetic field.

7. The shoulder support according to claim 6, wherein the thermoplastic material which forms the support element has a transition temperature in the thermoplastic range Tg between approximately 43° C. and approximately 60° C., in particular of approximately 50° C.

8. The shoulder support according to claim 6, wherein the thermoplastic material which forms the support element has a density of between 0.8 and 1.5 g/cm$^3$, preferably of approximately 1.1 g/cm$^3$.

9. The shoulder support according to claim 6, the support element of which has a cross-sectional area of at least 100 mm$^2$ and at most 250 mm$^2$ with respect to the longitudinal direction thereof.

10. The shoulder support according to claim 6, the support element of which has a thickness of at least 2 mm and at most 7 mm, preferably of at least 3 mm and at most 6 mm, particularly preferably of at least 3.4 mm and at most 5.5 mm.

11. The shoulder support according to claim 6, the support element of which has a width of at least 20 mm and at most 45 mm, preferably of at least 30 mm and at most 35 mm.

12. The shoulder support according to claim 1, wherein all of the holes are selected to be of substantially the same size in terms of their diameter.

* * * * *